United States Patent [19]

Kellett

[11] Patent Number: 4,938,879

[45] Date of Patent: Jul. 3, 1990

[54] STEARATE-BASED DRYER-ADDED FABRIC SOFTENER SHEET

[75] Inventor: George W. Kellett, Cranford, N.J.

[73] Assignee: Creative Products Resource Associates, Ltd., Clifton, N.J.

[21] Appl. No.: 331,870

[22] Filed: Apr. 4, 1989

[51] Int. Cl.[5] ..... B05D 3/12; D06M 13/02; D06M 13/17; D06M 13/48

[52] U.S. Cl. ..... 252/8.75; 252/8.9; 252/8.8; 252/8.6; 427/242

[58] Field of Search ..... 252/8.6, 8.75, 8.8; 427/242

[56] References Cited

U.S. PATENT DOCUMENTS

| | | | |
|---|---|---|---|
| 2,251,328 | 8/1941 | Ehret | 252/134 |
| 3,442,692 | 5/1969 | Gaiser | 117/120 |
| 3,650,816 | 3/1972 | Rudy et al. | 117/109 |
| 3,936,538 | 2/1976 | Marshall et al. | 427/242 |
| 4,022,938 | 5/1977 | Zaki et al. | 427/242 |
| 4,511,495 | 4/1985 | Melville | 252/522 |
| 4,514,444 | 4/1985 | Ives et al. | 427/242 |
| 4,532,063 | 7/1985 | Gueldenzopf | 252/90 |
| 4,557,852 | 12/1985 | Schulz et al. | 252/95 |
| 4,566,980 | 1/1986 | Smith | 252/8.6 |
| 4,581,385 | 4/1986 | Smith et al. | 521/111 |

FOREIGN PATENT DOCUMENTS

| | | | |
|---|---|---|---|
| 1017101 | 9/1977 | Canada | 8/93.11 |
| 225848 | 6/1987 | European Pat. Off. . | |
| 2416937 | 7/1979 | France . | |
| 1598449 | 9/1981 | United Kingdom . | |

*Primary Examiner*—A. Lionel Clingman
*Assistant Examiner*—J. Darland
*Attorney, Agent, or Firm*—Merchant, Gould, Smith, Edell, Welter & Schmidt

[57] ABSTRACT

A fabric softener sheet for in-dryer use is provided which comprises water, an organic solvent, and an amount of an alkali metal stearate effective to dimensionally-stabilize the sheet, having uniformly distributed in said sheet an effective amount of a quaternary amine fabric softening agent.

22 Claims, No Drawings

STEARATE-BASED DRYER-ADDED FABRIC SOFTENER SHEET

BACKGROUND OF THE INVENTION

Certain chemical compounds have long been known in the art to possess the desired quality of imparting softness to textile fabrics. The quality of "softness" or being "soft" is well defined in the art, and, as used herein, means that quality of the treated fabric whereby its handle or texture is smooth, pliable, and fluffy, and not rough or scratchy to the touch. Known generally as "fabric softeners," these compounds have long been used by homemakers in the laundry, and by the textile industry to soften a finished fabric.

Additionally, many of these compounds act to reduce the "static cling" of the treated fabrics. Static cling is generally the phenomenon of a fabric adhering to another object or to parts of itself as a result of static electrical charges located on the surface of the fabric. It can also cause the adherence of lint, dust, and other undesired substances to the fabric. It is noticeably present in unsoftened fabrics that are freshly washed and dried in an automatic hot air dryer. By softening and reducing the static cling of a fabric, it is more comfortable when worn. Such treated fabrics additionally are easier to iron, and have fewer hard-to-iron wrinkles.

Perhaps the most common fabric conditioners known in the art are cationic compounds, especially amines such as quaternary ammonium and imidazolinium salts. These compounds are widely marketed for home use in the form of liquid emulsions. They must be added to the laundry in the rinse cycle, not the wash cycle, because cationic fabric conditioners interact with anionic substances present in laundry detergents such as anionic surfactants and builder salts, thereby rendering both relatively ineffective. A commercial fabric conditioner of this type is Downy ®. (The Procter & Gamble Company, Cincinnati, OH).

Another means of providing fabric conditioning is disclosed in Gaiser, U.S. Pat. No. 3,442,692, issued May 6, 1969, incorporated herein by reference, comprising a fabric-conditioning composition in conjunction with a dispensing means for use in a hot air dryer. Preferred articles had the fabric-conditioning composition releasably affixed to an absorbent substrate, such as a nonwoven tissue, in the form of an impregnate or coating of cationic fabric-conditioning agent. The use of certain polyols, especially sorbitan esters as auxiliary fabric-conditioning agents in products of this kind, is disclosed in Zaki et al., U.S. Pat. No. 4,022,938, issued May 10, 1977, incorporated herein by reference. A commercial product that has utilized the teachings of Gaiser and Zaki et al. is Bounce ®, The Procter & Gamble Company.

Substrates having fabric-conditioning agents adhered to substrates formed from natural or synthetic organic polymers have also been disclosed. For example, Schulz et al., U.S. Pat. No. 4,557,852, disclose a watersoluble sheet formed from a synthetic acrylate-type polymer which encloses a fabric softener or a bleach. This laundry care additive is added to the washing machine. Marshall et al., U.S. Pat. No. 3,936,538, disclose a fabric-softening composition for use in the dryer consisting of a sheet of a film-forming polymer having a molecular weight of at least 100,000, a fabric softener and a surfactant. However, these compositions leave a "crumpled sheet residue behind" in the dryer.

Therefore, both the "absorbent substrate" and "all-chemical" type in-dryer softeners disclosed hereinabove can leave a residual base sheet which must be removed following the completion of the drying cycle. These sheets may be reuseable to some extent, but the user has no way to readily determine whether or not sufficient softener is retained on the base sheet. Furthermore, although these products are easy to dispense, their efficacy depends on the efficient release of the fabric conditioner from a substrate which does not participate in the drying process, and which may itself decompose to soil the dried laundry. Also, in-dryer sheets generally do not soften as well as liquids, since the sheets may not contact all of the laundry evenly during the drying process. This can also lead to staining of the laundry due to the uneven release of the softener.

Therefore, there is a need for a solid fabric softener for use in an automatic hot air clothes dryer which is convenient to use, which softens effectively and which does not stain or otherwise soil the dried laundry.

BRIEF DESCRIPTION OF THE INVENTION

The present invention provides a fabric softener comprising a gelled sheet that imparts softening and antistatic properties to laundry while leaving no significant residue in the dryer after use therein. The sheet comprises water, a glycol ether, and an effective gel-forming amount of an alkali metal stearate. Uniformly distributed throughout said sheet is an effective amount of a quaternary amine fabric softening agent. Preferably, the sheets will comprise a surfactant to enhance the dispersal of the sheet in the dryer.

The present softener sheets are dimensionally stable, so that they can be readily dispensed by the user and added to the dryer in discrete units, along with, prior to, or after adding wet, laundered clothing or other laundered items. However, during drying of the laundry, the gelled solvent matrix evaporates, or otherwise disperses, and the softeners are spread evenly onto the fabrics. No, or an insignificant residue from the present sheets, remains in a conventional rotary hot air dryer following the drying cycle, so there is nothing for the user to remove but the dried laundry, which has been uniformly softened and rendered static-free, without being stained. As used herein, the term "insignificant" means that less than 5%, preferably less than 1%, and most preferably, 0% by weight of each sheet used, remains in the dryer after the laundry has been dried, either as free matter, or adhered to the dryer surface.

Therefore, the invention is also directed to a method for depositing softening agents on fabrics in a rotary hot air dryer comprising placing one or more of the present sheets in the dryer with the wet fabrics, and operating the dryer to dry the fabrics. The term "laundry" or "fabrics" encompasses not only clothing, but other items which are commonly cleaned via household or institutional laundering, including sheets, draperies, rugs, upholstery coverings, towels and the like. As used herein, the term "dryer" refers to a rotary hot air dryer, which tumbles the clothes in a drum with hot air, usually at a temperature of about 40–90° C., preferably at about 50–95° C.

Since the gelled lattice of the present sheets is thermally unstable in that it disintegrates, solubilizes in the latent water carried in the wet laundry, and disperses when exposed to the elevated temperature in the dryer, the present sheets are fundamentally different from the water-soluble polymeric sheets disclosed by Schulz et al. or Marshall et al., hereinabove, which are intended to provide a thermally-stable matrix to protect and/or deliver fabric conditioning or laundry care additives. However, since the present sheets are water-soluble, they can be used in the washing machine as well. The present sheets also do not incorporate a water-insoluble support or reinforcing matrix of any type, e.g., of plastic, foam or textile.

DETAILED DESCRIPTION OF THE INVENTION

The present sheets are preferably prepared by forming a uniform, heated liquid dispersion of a quaternary amine fabric-softening agent, a surfactant, an alkali metal stearate, and, optionally, fragrance in an aqueous glycol ether; and cooling and forming said mixture into a dimensionally-stable gelled sheet.

FABRIC SOFTENING AGENT

The present softener sheet gels will include an amount of one or more fabric-softening agents uniformly dispersed throughout the body of the sheet. Many useful fabric-softening agents are known to the art, and are disclosed, for example, in U.S. Pat. Nos. 3,936,538; 4,566,980 and 4,581,385, disclosures of which are incorporated by reference herein.

One broad class of these agents can be referred to as quaternary amines, or "quats." These materials function to condition the dried fabrics and to reduce static cling and lint adherence. The fabrics are softened in that their sheen, loft, and/or hand-feel is improved by either subjective or objective evaluation. Additionally, any given softening agent or mixture thereof is selected so that it will not significantly stain or discolor the dried fabrics.

Subclasses of these materials are referred to by the art as monomethyl trialkyl quaternaries, imidazolinium quaternaries, dimethyl alkyl benzyl quaternaries, dialkyl dimethyl quaternaries, methyl dialkoxy alkyl quaternaries, diamido amine-based quaternaries and dialkyl methyl benzyl quaternaries wherein the "alkyl" moiety is preferably a ($C_8$–$C_{24}$)alkyl group and the quaternary (amine) is a chloride or methosulfate salt.

For convenience, one subclass of aliphatic quaternary amines may be structurally defined as follows:

$$(R)(R_1)(R_2)(R_3)N^+X^-$$

wherein R is benzyl, or lower(alkyl) benzyl; $R_1$ is alkyl of 10 to 24, preferably 12 to 22 carbon atoms; $R_2$ is $C_{10}$–$C_{24}$-alkyl, $C_1$–$C_4$-alkyl, or ($C_2$–$C_3$)hydroxyalkyl, $R_3$ is $C_1$–$C_4$-alkyl or ($C_2$–$C_3$)hydroxyalkyl and X represents an anion capable of imparting water solubility or dispersibility including chloride, bromide, iodide, sulfate and methosulfate. Particularly preferred species of these aliphatic quats include n–$C_{12}$–$C_{18}$-alkyl-dimethylbenzylammonium chloride (myrisalkonium chloride), n-$C_{12}$–$C_{14}$-alkyldimethyl(ethylbenzyl) ammonium chloride (quaternium 14), dimethyl(benzyl)ammonium chloride and mixtures thereof. These compounds are commercially available as the BTC series from Onyx Chemical Co., Jersey City, NJ. For example, BTC 2125M is a mixture of myrisalkonium chloride and quaternium-14. Di-hydrogenated tallow methyl benzyl ammonium chloride is available as Variquat® B-343 from Sherex Chem. Co., Dublin, OH. This class of quat is germicidal, and is preferably used in combination with at least one of the other quats disclosed hereinbelow.

Other useful aliphatic quats include those wherein both R and $R_1$ are ($C_8$–$C_{24}$)alkyl, e.g., the N,N-di-(higher)-$C_{10}$–$C_{24}$-alkyl-N,N-di(lower-$C_1$– C-hd 4-alkyl-quaternary ammonium salts such as distearyl(dimethyl)ammonium chloride, di-hydrogenated tallow(dimethyl-)ammonium chloride, di-tallow-(dimethyl)ammonium chloride (Arquad® 2HT-75, Akzo Chemie, McCook, IL), distearyl(dimethyl)ammonium methylsulfate and di-hydrogenated-tallow(diemthyl) ammonium methyl sulfate (Varisoft® 137, Sherex).

Other useful quaternary ammonium anti-static agents include the acid salts of (higher(alkyl)-amido(lower)alkyl)-dialkyl)-amines of the general formula:

$$[(A(C{=}O)-Y)-N(R_1)(R_2)(R_3)]^+X^-$$

wherein A is a $C_{14}$–$C_{24}$ normal or branched alkyl group, Y is ethylene, propylene or buytylene, $R_1$ and $R_2$ are individually H, $C_1$–$C_4$ (lower)alkyl or ($C_1$–$C_3$)hydroxyalkyl or together form the moiety —$CH_2$—$CH_2YCH_2$—$CH_2$—, wherein Y is NH, O or $CH_2$; $R_3$ is the same as $R_1$ or is also [A(C=0)Y—], and X is the salt of an organic acid. Compounds of this class are commercially available from Croda, Inc., New York, NY, as the Incromate® series, e.g. Incromate® IDL [isostearamidopropyl(dimethyl)amine lactate], Incromate® ISML [isostearamidopropy(morpholinium)lactate]and Incromate® CDP [cocamidopropyl(dimethyl)amine propionate]. Ditallowdiamido methosulfate (quaternium 53) is available from Croda as Incrosoft® T-75.

Preferred imidazolinium salts include: (methyl-1-tallow-amido)ethyl-2-tallow imidazolinium methyl sulfate; available commercially from Sherex Chemical Co. as Varisoft® 475; (methyl-1-oleylamido)ethyl-2-oleyl imidazolinium methyl sulfate; available commercially from Sherex Chemical Co. as Varisoft® 3690, tallow imidazolinium methosulfate (Incrosoft® S-75, Croda) and alkylimidazolinium methosulfate (Incrosoft® CFI-75, Croda).

Other useful amine salts are the stearyl amine salts that are soluble in water such as stearyl-dimethylamine hydrochloride, distearyl amine hydrochloride, decyl pridinium bromide, the pyridinium chloride derivative of the acetylaminoethyl esters of lauric acid, lauryl trimethyl ammonium chloride, decylamine acetate and bis-[(oleoyl)-(5,8)-ethanoloxy]-tallow($C_{14}$–$C_{18}$)aminehydrogen phosphate (Necon® CPS-100) and the like.

NONIONIC SURFACTANT

One or more surfactants can optionally be used in the present softener sheets, to assist in the formation of a uniform liquid dispersion which is the precursor of the present sheets, and to assist the dispersal of the sheets in the dryer. Nonionic surfactants or amphoteric surfactants are preferred for use in the present invention and can also act as adjunct fabric softeners. Nonionic surfactants include the condensation products of ethylene oxide with a hydrophobic polyoxyalkylene base formed by the condensation of propylene oxide with propylene glycol. The hydrophobic portion of these compounds has a molecular weight sufficiently high so as to render it water-insoluble. The addition of polyoxyethylene moieties to this hydrophobic portion increases the water-solubility of the molecule as a whole, and the liquid character of the product is retained up to the point where the polyoxyethylene content is about 50% of the total weight of the condensation product. Examples of compounds of this type include certain of the commercially-available Pluronic® surfactants (BASF Wyandotte Corp.), especially those in which the polyoxypropylene ether has a molecular weight of about 1500–3000 and the polyoxyethylene content is about 35–55% of the molecule by weight, i.e., Pluronic® L-62.

Preferred nonionic surfactants include the condensation products of $C_8$–$C_{22}$ alkyl alcohols with 2–50 moles of ethylene oxide per mole of alcohol. Examples of compounds of this type include the condensation products of $C_{11}$–$C_{15}$ fatty alcohols with 3–50 moles of ethylene oxide per mole of alcohol which are commercially available from Shell Chemical Co., Houston, TX, as, i.e., Neodol® 23–6.5 ($C_{12}$–$C_{13}$ fatty alcohol condensed with about 7 moles of ethylene oxide), the PolyTergent® SLF series from olin Chemicals or the Tergitol® series from Union Carbide, i.e., Tergitol® 15–S–15, which is formed by condensing about 15 moles of ethylene oxide with a $C_{11}$–$C_{15}$ secondary alkanol; Tergitol® TMN-6, which is the condensation product of about 6 moles of ethylene oxide with isolauryl alcohol (CTFA name: isolaureth-6), Incropol® CS-12, which is a mixture of stearyl and cetyl alcohol condensed with about 12 moles of ethylene oxide (Croda, Inc.) and Incropol® L-7, which is lauryl alcohol condensed with about 7 moles of ethylene oxide (Croda, Inc.).

Preferred nonionic surfactants also include ($C_8$–$C_{24}$)fatty acid amides, e.g., the monoamides of a mixture of arachidic and behenic acid (Kenamide® B, Humko Chem. Co., Memphis, TN), and the mono- or dialkanolamides of ($C_8$–$C_{22}$)fatty acids, e.g., the diethanol amide, monoethanol amide or monoisopropanolamide of coconut, lauric, myristic or stearic acid, or mixtures thereof. For example, Monamide® S is the monoethanol amide of stearic acid (Mona Industries, Inc., Patterson, NJ).

Other nonionic surfactants which may be employed include the ethylene oxide esters of $C_6$–$C_{12}$ alkyl phenols such as (nonylphenoxy)polyoxyethylene ether. Particularly useful are the esters prepared by condensing about 8–12 moles of ethylene oxide with nonylphenol, i.e., the Igepal® CO series (GAF Corp., New York, NY).

Other useful nonionics include the ethylene oxide esters of alkyl mercaptans such as dodecyl mercaptan polyoxyethylene thioether, the ethylene oxide esters of fatty acids such as the lauric ester of polyethylene glycol and the lauric ester of methoxypolyethylene glycol, the ethylene oxide ethers of fatty acid amides, the condensation products of ethylene oxide with partial fatty acid esters of sorbitol such as the lauric ester of sorbitan polyethylene glycol ether, and other similar materials, wherein the mole ratio of ethylene oxide to the acid, phenol, amide or alcohol is about 5–50:1.

Useful amphoteric surfactants are known to the art, e.g., as disclosed in Marshall et al. (U.S. Pat. No. 3,936,538), the disclosure of which is incorporated by reference herein.

STEARATE

The present gelled softener sheets will also include an amount of an alkali metal salt of stearic acid which is effective to get the liquid dispersions when they are coated and formed into sheets. Commercially-available salts of stearic acid can be used, e.g., the sodium stearate that is available from Witco Chem. Co. as Grade T-1. However, the stearate salt can be formed in situ in the liquid dispersion, by neutralizing stearic acid with a base such as an alkali metal hydroxide, e.g., LiOH, KOH, or NaOH, which may be added to the dispersion as an aqueous solution.

SOLVENT SYSTEM

The present sheets are formed by dispersing the above-described active ingredients in an aqueous solvent system which preferably comprises a water-miscible organic co-solvent or solvent system, most preferably a glycol ether. These materials are lower(alkoxy)- or lower-(alkoxy)lower(alkoxy)-ethers of ethanol or isopropanol. Many glycol ethers are available under the tradenames Arcosolv® (Arco Chemical Co.) or Cellosolve®, Carbitol®, or Propasol®(Union Carbide Corp.), and include, e.g., butylCarbitol®, hexylCarbitol®, methylCarbitol®, and Carbitol® itself, (2-(2-ethoxy)ethoxy)ethanol. The choice of glycol ether can be readily made by one of skill in the art on the basis of its volatility, water-solubility, wt-% of the total dispersion and the like. Pyrrolidinone solvents such as N-methyl-2-pyrrolidinone (M-Pyrol®) or 2-pyrrolidone (2Pyrol®) can also be used. Minor amounts of alkanols such as isopropanol or n-butanol can also be included.

FRAGRANCE

Minor but effective amounts of a volatile odoriferous agent selected so as to be chemically compatible with the above-described materials are preferably included in the sheets to deodorize the fabrics. Useful fragrances include oils such as rose oil, lavender, lilac, jasmine, vanilla, wisteria, lemon, apple blossom, or compound bouquets such as citrus, spice, aldehydic, woody, oriental, and the like.

ADJUVANTS

Other fabric conditioning or modifying adjuvants, such as preservatives, brightening agents, shrinkage controllers, specific antistatic agents, soil repellants, fumigants, fungicides, germicides, lubricants and sizing agents, can also be included on the present sheets wherein such adjuvants are compatible with the fabric-softening agent and the surfactant.

The present dispersions are formed by combining the active ingredients in a mixture of the glycol ether and water under suitable conditions of agitation and temperature control. The solid gelled sheets are formed from the finished dispersion, e.g., by casting the dispersion onto a suitable moving or stationary surface, as by dipping, spraying or brushing the dispersion onto the surface of a mold, plate or movable belt. See U.S. Pat. No. 3,936,538, the disclosure of which is incorporated by reference herein. The finished sheet may be perforated for division into smaller units, or simply cast into its enduse size. The individual sheets or a strip comprising a plurality of sheets separated by perforations may be packaged, e.g., using protective release sheets, in an appropriate dispensing unit. The present sheets can also be made by coating a cooled metal roller with the reaction mixture and removing the cast sheet with a doctor blade to control its thickness.

Therefore, the aqueous dispersions used to form the present softening sheets will comprise, by weight, about 40–60% water-miscible organic solvent, preferably about 45–55% of a glycol ether or a pyrrolidinone solvent; about 10–30%, preferably about 15–27.5% total water; about 2.5–25%, preferably about 5–15% quaternary amine softening agent; about 7–20% alkali metal stearate; and optionally, about 1–10% of a surfactant, preferably about 2.5–7.5% of a nonionic surfactant, and a minor but effective amount of fragrance, e.g., ≦1%. The invention will be further described by reference to the following detailed examples.

EXAMPLE 1

FABRIC SOFTENING SHEET

Carbitol ® solvent ((2-(2-ethoxyethoxyethanol, 49 g) is added to a beaker equipped with mechanical stirring, followed by 13.3 g of water. The stirred reaction mixture is heated to 60° C., at which point 12.25 g of stearic acid (Neofat ® 18, Armak Co., McCook, IL) is added. When the temperature of the reaction mixture reaches 75° C., 3.45 g of 50% aqueous sodium hydroxide is slowly added, raising the temperature of the reaction mixture to about 80–85° C. After the neutralization reaction is completed, the temperature is maintained at 80° C. Incrosoft ® T-75 softener (quaternium 53, 14.1 g, Croda, 75% active) is added, and stirring continued until the reaction mixture is homogeneous. Incropol ® CS-12 surfactant (ceteareth-12, 2.36 g) and Kenamide ® B surfactant (behenamide/arachidamide 4.71 g) are slowly added, followed by 0.7 g of fragrance. After 1–2 minutes of additional stirring, stirring is discontinued. The reaction mixture is cast into thin sheets by dipping a highly polished chrome plate into the 80° C. reaction mixture for 5 seconds. The liquid-coated plate is removed and cooled and the gelled sheet is stripped from the plate. Flexible translucent sheets resulted which were about 12.7 cm square (2.1–2.3 g).

Test fabrics (towels and sheets) are washed with a 15 min regular wash cycle (warm wash/cold rinse; water level, medium). One softener sheet is placed in the dryer drum with the damp wash and dried for a total of 55 min. After 20 min, the softener sheet is completely consumed and the test fabrics are effectively softened without visible staining.

EXAMPLES 2–6

Examples 2–6 were carried out using the procedure of Example 1, to yield softener sheets that were also effective to soften and neutralize static test fabrics under the best conditions described hereinabove, without leaving a visible residue in the dryer drum. The compositions of the sheets of Examples 2–6 are summarized on Table I, below.

TABLE I

| Ingredient | Example No. 2 | 3 | 4 | 5 | 6 |
|---|---|---|---|---|---|
| Solvent | | | | | |
| Carbitol ® | 47.9 | 54.1 | 51.4 | 54.1 | 51.4 |
| Water(total) | 14.7 | 17.4 | 15.8 | 19.4 | 15.8 |
| Softener | | | | | |
| Incrosoft ® T-75 (Quaternium −53)[a] | 18.4 | 5.2 | 9.9 | 3.9 | 7.4 |
| Incrosoft ® S-75 (Quaternium −27)[b] | — | — | — | 1.3 | 2.5 |
| Stearic acid | 12.0 | 13.5 | 12.9 | 13.5 | 12.9 |
| NaOH | 1.7 | 1.9 | 1.8 | 1.9 | 1.8 |
| Surfactant | | | | | |
| Behenamide/ Arachidamide[c] | 4.6 | 4.7 | 5.0 | 5.2 | 4.95 |

TABLE I-continued

| Ingredient | Example No. 2 | 3 | 4 | 5 | 6 |
|---|---|---|---|---|---|
| Ceteareth −12[d] | — | 2.4 | 2.5 | 2.6 | 2.54 |
| Fragrance | 0.7 | 0.8 | 0.7 | 0.8 | 0.8 |

[a](75% actives, Croda Surfactants, Inc., NY, NY)
[b](75% actives, Croda)
[c]Kenamide ® B (Witco Chem. Co., Memphis, TN)
[d]Incropol ® CS-12 (Croda)

EXAMPLES 7–13.

Examples 7–13 were carried out using the procedures of Example 1, except that in Examples 12–13, the neutralization step was omitted and preformed sodium stearate was used. All of the examples yielded sheets which were satisfactory in terms of their dimensioned stability.

The sheets were about 100–175 $cm^2$, about 0.45–0.65 mm thick and weighed about 6.5–8.5 g.

The sheets were evaluated in a Beaumark dryer along with a fixed test load for residue (%), static [volts; Bounce ® =1776 v]and staining [0–30 scale, Bounce =5.4], by the following protocols:

TEST FABRICS

One sheet from each example was evaluated in the dryer with a wet load consisting of ten pieces of the following description: 2 pieces woven polyester (color fuchsia), 2 pieces nylon tricot (mauve), one piece cotton/polyester broadcloth (green), 2 pieces acrylic plush (yellow and aqua), one cotton/polyester pillowcase (bluegray), one piece polyester knit (blue), and one acrylic sweater (white), two bath-size 90% cotton/10% polyester towels and one hand-size towel of the same fiber blend. The total dry fabric weight is about 5 lbs.

RESIDUE

After drying fabrics with the test sheet, test fabrics are removed from dryer and the inside of dryer is closely inspected for residue. Residue may be found as pieces in the lint trap, in the mouth of the dryer opening, tangled in the clothes, on the floor outside the dryer (from falling from clothes when they are removed), loose inside the dryer drum, or adhering to the dryer drum. All residue is collected and weighed and the residue is expressed as a percentage of original sample weight.

STATIC

Static voltage is measured for each item in a bulk load and individual voltages are summed to give total voltage for the load.

SOFTENING

Softening is assessed using towels which have been laundered and dried along with other bulk load items. Three internal replicates are used in each test. Towels which are evaluated against each other (each having been treated with a test sample or Bounce ® control in the dryer) are ranked for softness as less than (<), equal to (=), or greater than (>) the softening ability of the Bounce ® sheet.

FABRIC STAINING

Fabric staining is assessed on six stain-prone items which are part of the 5 lb. standard bulk load. Items are:

2 pieces woven 100% polyester, 2 pieces 100% nylon tricot, one 65/35% cotton/polyester pillowcase, and one square meter 65/35% cotton/polyester broadcloth. Burgundy, fuchsia, royal blue, and emerald green have been found to be the most beneficial colors for stain visualization.

Staining is assessed immediately after fabrics are removed from the dryer. Each stain-prone fabric is visually inspected for any mark, which may be in the form of dark, oily, irreguarly-shaped spots, streaks, or patches, or white, oily or powdery spots, streaks, or patches which are sometimes (but not always) removable by scraping. Staining of each fabric is rated according to the following scale and the numbers are totalled.

0 = no staining
1 = very slight staining (few small dots)
2 = slight staining (several small dots or streaks)
3 = moderate staining (dots, streaks, up to ½ in. patches)
4 = severe staining (all above + a few patches > ½ in.)
5 = very severe staining (all above + several > ½ in. patches)

The compositions of the sheets of Examples 7–13 are summarized on Table 2, below, along with the averages of the length, width, thickness, initial weight, residue (%), static, and fabric staining for three sheets from each example. All of the sheets deposited no or an insignificant amount of residue in the dryer, and performed at least as well as the Bounce® control sheet in the static, softness and fabric staining evaluations described hereinabove.

TABLE II

| Ingredient | Example 7 | 8 | 9 | 10 | 11 | 12 | 13 |
|---|---|---|---|---|---|---|---|
| Solvent | | | | | | | |
| Carbitol® | 50.4 | 48.1 | 51.2 | 47.3 | 50.4 | 57.2 | 56.9 |
| Water(total) | 21.7 | 21.8 | 21.2 | 21.1 | 21.1 | 17.5 | 17.0 |
| Softener | | | | | | | |
| Incrosoft T-75 (Quaternium-53)[a] | 5.0 | — | — | 3.5 | 5.0 | — | 5.0 |
| 90% Varisoft® 137[b] | 4.2 | 8.2 | 8.3 | 8.7 | 4.2 | 8.3 | 4.2 |
| Sodium Stearate | — | — | — | — | — | 12.2 | 12.2 |
| Stearic Acid | 12.3 | 12.3 | 12.2 | 12.2 | 12.2 | — | — |
| NaOH | 1.7 | 1.7 | 1.7 | 1.7 | 1.7 | — | — |
| Surfactant | | | | | | | |
| Behenamide/ Arachidamide[c] | 4.7 | 4.7 | 4.7 | 4.7 | 4.7 | 4.7 | 4.7 |
| Ceteareth-12[d] | — | 2.4 | — | — | — | — | — |
| Fragrance | — | 0.8 | 0.7 | 0.7 | 0.7 | — | — |
| Properties of Sheet | | | | | | | |
| Length (cm) | 14.1 | 11.9 | 11.3 | 12.5 | 13.6 | 14.4 | |
| Width (cm) | 12.4 | 9.9 | 9.8 | 11.7 | 11.1 | 13.2 | |
| Thickness (cm) | 0.5 | 0.7 | 0.8 | 0.6 | 0.53 | 0.4 | — |
| Weight (g) | 7.3 | 8.3 | 7.7 | 8.2 | 8.0 | 7.4 | — |
| Residue (%) | 1.7 | 9.5 | 8.2 | 4.5 | 5.4 | 1.2 | —* |
| Static (v) | 2,199 | 1,622 | 9,024 | 3,112 | 2,357 | 1,487 | —* |
| Softness | N/T | N/T | = | N/T | N/T | N/T | —* |
| Fabric staining | 4.75 | 5.5 | 3.0 | 6.5 | 7.3 | 4.8 | —* |

[a](75% Ditallow Diamido Methosulfate)
[b]90% Dihydrogenated-tallow dimethylammonium methosulfate (Sherex Chem. Co., Dublin, OH)
[c]Kenamide® B
[d]Incropol® CS-12
*The sheet prepared according to Example 13 also performed satisfactorily in these tests.

The invention has been described with reference to various specific and preferred embodiments and techniques. However, it should be understood that many variations and modifications may be made while remaining within the spirit and scope of the invention.

What is claimed is:

1. A fabric softener comprising a gelled sheet comprising water, a water-miscible organic solvent, and an effective gel-forming amount of an alkali metal stearate, having uniformly distributed therein an effective amount of a quaternary amine fabric softening agent.

2. The softener of claim 1 wherein the organic solvent comprises a glycol ether.

3. The softener of claim 2 wherein the glycol ether comprises 2-[(2-ethoxy)ethoxy]ethanol.

4. The softener of claim 1 which comprises sodium stearate.

5. The softener of claim 1 wherein the fabric softening agent comprises an imidazolinium salt.

6. The softener of claim 5 wherein the fabric softening agent comprises tallow imidazolinim methosulfate.

7. The softener of claim 1 wherein the fabric softening agent comprises an ammonium salt.

8. The softener of claim 7 wherein the fabric softening agent comprises a [di($C_8$–$C_{24}$)alkyl]dimethylammonium salt.

9. The softener of claim 8 wherein the fabric softening agent comprises (dihydrogenated-tallow)dimethyl ammonium methosulfate.

10. The softener of claim 7 wherein the fabric softening agent comprises ditallow diamido methosulfate.

11. The softener of claim 1 wherein the sheet further comprises a nonionic or amphoteric surfactant.

12. The softener of claim 11 wherein the surfactant comprises a fatty acid amide or a fatty acid alkanolamide.

13. The softener of claim 1 which further comprises fragrance.

14. A fabric softener comprising a gelled sheet formed by a process comprising:

(a) forming a uniform liquid dispersion of a quaternary amine fabric softening agent, and an alkali metal stearate in an aqueous glycol ether;

(b) forming said mixture into a dimensionally-stable gelled sheet.

15. The softener of claim 14 wherein the dispersion further comprises fragrance.

16. The softener of claim 14 wherein the alkali metal stearate is formed in the dispersion by neutralizing stearic acid with an alkali metal hydroxide.

17. The softener of claim 16 wherein the alkali metal hydroxide is NaOH.

18. The softener of claim 14 wherein the dispersion comprises about 10–30% water and about 40–60% glycol ether.

19. The softener of claim 14 wherein the dispersion comprises about 2.5–25% of a quaternary amine softening agent.

20. The softener of claim 14 wherein the dispersion further comprises about 1–10% of a surfactant.

21. The softener of claim 18 wherein the dispersion comprises about 7–20% sodium stearate.

22. A method for depositing a fabric softening agent on fabrics in a rotary hot air dryer comprising placing the softener of claim 1 or claim 14 in the dryer with the wet fabrics, and operating the dryer to dry the fabrics.

* * * * *

UNITED STATES PATENT AND TRADEMARK OFFICE

CERTIFICATE OF CORRECTION

PATENT NO. : 4,938,879

DATED : July 3, 1990

INVENTOR(S) : George W. Kellet

It is certified that error appears in the above-identified patent and that said Letters Patent is hereby corrected as shown below:

Column 4, line 5, "(lower-$C_1$-C-hd 4" should be --(lower)-$C_1$-$C_4$--.

Column 4, line 15, insert --(-- before the word "dialkyl)".

Column 4, lines 48-49, "$C_{1-\ 8}$)" should be --$C_{18}$)--.

Signed and Sealed this

Twenty-fifth Day of February, 1992

*Attest:*

HARRY F. MANBECK, JR.

*Attesting Officer*

*Commissioner of Patents and Trademarks*